US006478239B2

(12) United States Patent
Chung et al.

(10) Patent No.: US 6,478,239 B2
(45) Date of Patent: Nov. 12, 2002

(54) HIGH EFFICIENCY FUEL OIL ATOMIZER

(75) Inventors: I-Ping Chung, Tulsa, OK (US); Christoph Strupp, Igel-Liersberg (DE)

(73) Assignee: John Zink Company, LLC, Tulsa, OK (US)

( * ) Notice: Subject to any disclaimer, the term of this patent is extended or adjusted under 35 U.S.C. 154(b) by 0 days.

(21) Appl. No.: 09/754,006

(22) Filed: Jan. 3, 2001

(65) Prior Publication Data

US 2001/0030247 A1 Oct. 18, 2001

Related U.S. Application Data

(60) Provisional application No. 60/177,828, filed on Jan. 25, 2000.

(51) Int. Cl.[7] ..... A62C 31/00; F02M 59/00; B05B 7/06; F23D 11/16

(52) U.S. Cl. ..... 239/398; 239/533.2; 239/424.5; 239/419

(58) Field of Search ..... 239/398, 418, 239/419, 423, 424.5, 427, 429, 425, 416.4, 416.5, 419.5, 433, 533.2; 251/127, 129.15, 129.21

(56) References Cited

U.S. PATENT DOCUMENTS

| | | | | |
|---|---|---|---|---|
| 2,192,996 A | | 3/1940 | Fenzl | |
| 4,002,297 A | | 1/1977 | Pillard | |
| 4,218,266 A | * | 8/1980 | Guazzoni et al. | 136/209 |
| 4,356,970 A | | 11/1982 | Vosper et al. | |
| 4,383,649 A | | 5/1983 | Reed et al. | |
| 4,708,293 A | * | 11/1987 | Graziadio et al. | 239/427 |
| 4,819,878 A | * | 4/1989 | Bailey et al. | 239/427 |
| 4,890,793 A | | 1/1990 | Fuglistaller et al. | |
| 5,143,297 A | * | 9/1992 | De Michele et al. | 239/427 |
| 5,170,942 A | | 12/1992 | Spink et al. | |
| 5,176,324 A | | 1/1993 | Furuse et al. | |
| 5,368,230 A | | 11/1994 | Oppenberg | |
| 5,826,798 A | | 10/1998 | Schindler et al. | |
| 5,829,683 A | | 11/1998 | Beaudoin et al. | |
| 5,860,600 A | | 1/1999 | Schindler et al. | |
| 6,010,329 A | | 1/2000 | Zagoroff | |

FOREIGN PATENT DOCUMENTS

JP 61070310 11/1986

OTHER PUBLICATIONS

Patent Abstracts of Japan, vol. 010, No. 238 (M–508) Aug. 16 (Aug. 16, 1986) & JP 61 070310 A (Mitsubishi Heavy Ind Ltd; Others: 01), Apr. 11, 1986 (abstract.

* cited by examiner

*Primary Examiner*—Michael Mar
*Assistant Examiner*—Davis Hwu
(74) *Attorney, Agent, or Firm*—James H. Marsh, Jr.; Stinson Morrison Hecker LLP

(57) ABSTRACT

A high efficiency liquid fuel atomizer includes an elongated generally tubular member defining a liquid fuel pre-atomization chamber. The tubular member has an outer wall that extends around the chamber, an upstream end adapted for connection to a source of liquid fuel and a downstream fuel delivery outlet. The atomizer also includes a larger diameter outer tube that is concentric to the tubular member and defines a generally annular pressurized atomizing fluid supply conduit disposed in surrounding relationship relative to the chamber. The outer tube has an inlet adapted for connection to a source of pressurized atomizing fluid and a downstream pressurized atomizing fluid delivery outlet. One or more orifices are provided in the outer wall of the tubular member so as to intercommunicate the chamber and the annular conduit to permit pressurized atomizing fluid to enter the chamber and at least partially atomize the fluid fuel therein. Also disclosed is an atomizing tip which includes a novel y-shaped for further atomizing the liquid fuel.

35 Claims, 2 Drawing Sheets

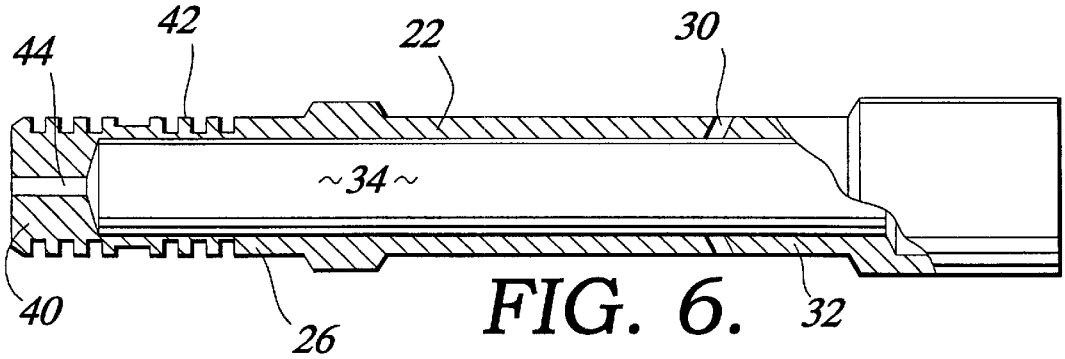
FIG. 6.
FIG. 8.
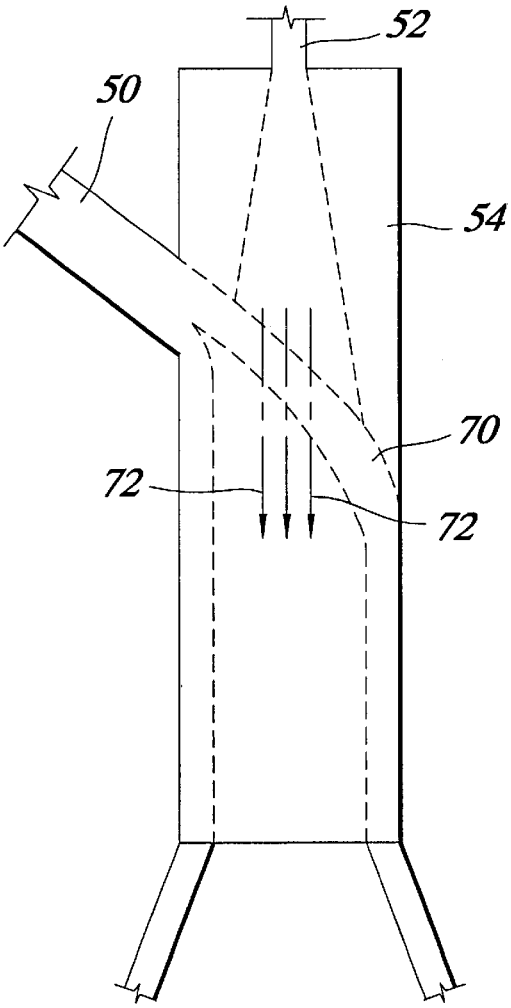
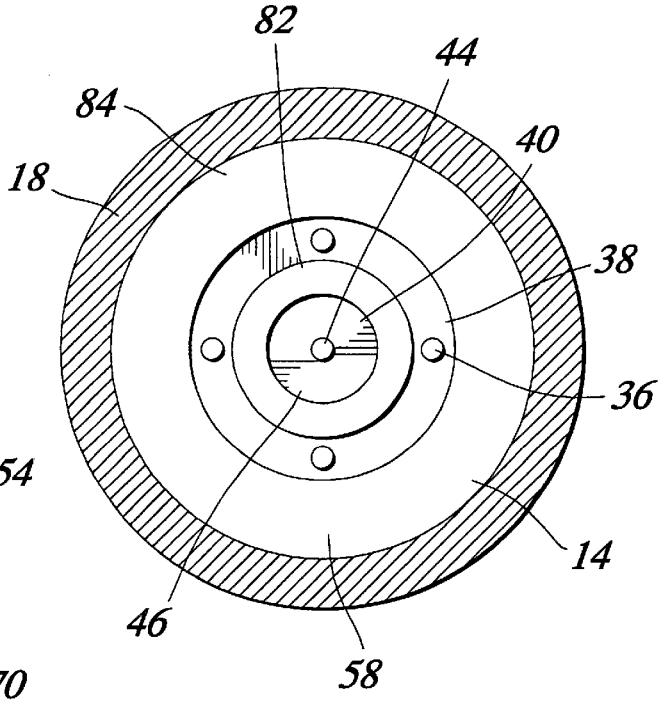
FIG. 7.

HIGH EFFICIENCY FUEL OIL ATOMIZER

REFERENCE TO RELATED APPLICATION

Priority is claimed in the present application pursuant to 35 U.S.C. § 119(e) from provisional application Ser. No. 60/177,828 filed Jan. 25, 2000.

BACKGROUND OF THE INVENTION

1. Field of the Invention

The invention of the present application relates to the field of oil fired burners, and in particular to atomizer nozzles for atomizing fuel oil with an atomizing fluid. Even more particularly, the invention relates to such an atomizer nozzle having a novel construction including an atomizer tip which is economically produced and in which the oil and the fluid are efficiently and effectively brought into contact with one another.

2. The State of the Prior Art

The state of the prior art is exemplified by the teachings of U.S. letters patent No. 5,368,280, which issued on Nov. 29, 1994 and by an article authored by P. J. Mullinger et al. entitled "THE DESIGN AND PERFORMANCE OF INTERNAL MIXING MULTIJET TWIN FLUID ATOMIZERS", *J. Inst. Fuel*, 1974 (December), 47,251–261. However, in spite of the many improvements which have been made in the fuel oil atomization field in the past, many problems still exist. From an economical view point, improvements in operational efficiency are continuously sought.

SUMMARY OF THE INVENTION

The present invention provides a high efficiency liquid fuel atomizer which reduces operational and maintenance costs as well as undesirable emissions. Due to its simple construction, the nozzle is also low in initial cost. In accordance with the concepts and principles of the invention, an embodiment of the nozzle may be constructed to include an elongated generally tubular member defining a liquid fuel pre-atomization chamber. This tubular member preferably may have an outer wall that extends at least partially around the chamber, an upstream end adapted for connection to a source of liquid fuel and a downstream fuel delivery outlet. The nozzle may also preferably include structure defining a generally annular pressurized atomizing fluid supply conduit disposed in surrounding relationship relative to the pre-atomization chamber. This structure may preferably include a conduit inlet adapted for connection to a source of pressurized atomizing fluid and a downstream pressurized atomizing fluid delivery outlet. The outer wall of the tubular member may have at least one orifice therethrough which is located so as to intercommunicate the chamber and the conduit so as to permit pressurized atomizing fluid to enter the chamber where it acts to at least partially atomize the fuel and create a first mixture of atomizing fluid and fuel in the chamber. The nozzle also may include an atomizing tip that has at least one internal mixing port arrangement that is in fluid communication with the fuel and fluid delivery outlets for receiving and intermixing therein the first mixture of fluid and fuel from the chamber and additional pressurized atomizing fluid from the conduit so as to further atomize the liquid fuel and create a second mixture of fluid and fuel.

In another preferred embodiment of the invention, a high efficiency liquid fuel atomizer is provided which includes an elongated generally tubular member defining a liquid fuel pre-heating chamber. The tubular member has an outer wall that extends at least partially around the chamber, an upstream end adapted for connection to a source of liquid fuel and a downstream fuel delivery outlet. In this form of the invention, the nozzle may include structure defining a generally annular pressurized atomizing fluid supply conduit that is disposed in surrounding relationship relative to the chamber. Such structure may preferably include a conduit inlet adapted for connection to a source of heated pressurized atomizing fluid and a downstream pressurized atomizing fluid delivery outlet. The nozzle may be constructed such that at least a portion of the outer wall of the tubular member is formed of a heat conductive material. This portion may have an inner surface positioned for being contacted by liquid fuel in the chamber and an outer surface positioned for being contacted by heated pressurized atomizing fluid in the conduit whereby the fuel is heated by transfer of heat from the heated fluid to the fuel through the heat conductive material of the portion. The nozzle may also include an atomizing tip including at least one mixing port arrangement that is in fluid communication with the delivery outlets for receiving and intermixing heated liquid fuel from the chamber and atomizing fluid from the conduit whereby to atomize the heated liquid fuel.

In further accordance with the concepts and principles of the invention, an orifice may be provided through the outer wall. Such orifice may intercommunicate the chamber and the conduit so as to permit the heated and pressurized atomizing fluid to enter the chamber and at least partially atomize said fluid fuel therein.

In still further accordance with the preferred aspects of the invention, the port arrangement in the nozzle tip may be y-shaped and configured to include a first elongated port having an upstream end in fluid communication with the fuel delivery outlet and a downstream end, and a second elongated port having an upstream end in fluid communication with the fluid delivery outlet and a downstream end. The first and second ports may preferably be arranged at an angle and positioned such that the downstream end of the first port intersects with the second port at a location between the ends of the latter. With such an arrangement, the at least partially atomized fuel passing through the first port is intermixed in the second port with atomizing fluid passing through the second port. The atomizing fluid thus further atomizes the fuel and an admixture of atomized fuel and atomizing fluid is discharged from the nozzle tip through the downstream end of the second port. Also with such an arrangement of ports, heated fuel passing through the first port may be intermixed in the second port with atomizing fluid passing through said second port and atomized thereby and an admixture of atomized fuel and heated atomizing fluid may then be discharged through the downstream end of the second port. In addition, when such a port arrangement is employed, the heated and at least partially atomized fuel passing through the first port may be intermixed in the second port with atomizing fluid passing through the second port and atomized further thereby and an admixture of atomized fuel and heated atomizing fluid may then be discharged through the downstream end of the second port.

In a particularly preferred form of the invention, the fuel from the first port may be introduced into the second port as a cone shaped sheet that is positioned for being pierced by the atomizing fluid flowing through the second port. The fuel from the first port may be at least partially atomized and/or heated.

The invention also provides a high efficiency method for atomizing a liquid fuel. In one preferred form of the invention, the method may include providing a liquid fuel and causing the same to flow into and through a pre-atomization chamber. The method may further include injecting a first portion of a pressurized atomizing fluid into the liquid fuel flowing through the chamber so as to at least partially atomize said fuel and provide a first admixture containing atomized fuel and atomizing fluid. In accordance with the invention, the first admixture may then be delivered from the chamber and caused to flow into and through a first elongated port in an atomizing tip connected to said chamber. A second portion of pressurized atomizing fluid may be directed into a second elongated port in the tip and caused to flow through the second port. The first admixture from the first port may be introduced into the second port and caused to become intimately intermixed with the second portion of pressurized atomizing fluid so as to further atomize the fuel and provide a second admixture comprising atomized fuel and atomizing fluid. The second admixture may then be discharged from the tip. In accordance with the particularly preferred aspects of the invention, the liquid fuel may be heated in the chamber.

In a preferred form of the invention, the chamber may be elongated and generally tubular in form and the atomizing fluid may be caused to flow in an annular flow path in surrounding relationship to an outer wall of the chamber. In this form of the invention, the injecting of the fluid into the chamber may be accomplished via an opening provided in the wall.

In accordance with the preferred aspects of the invention, first admixture is introduced into the second port as a cone shaped sheet that is pierced by the atomizing fluid flowing through the second port. In accordance with another preferred aspect of the invention, the ports are arranged at an angle, the second port has an inlet end and an outlet end, and the first port is positioned so as to intersect with the second port at a location between the ends thereof. In accordance with the principles and concepts of the invention, the chamber may preferably be elongated and generally tubular in form and the atomizing fluid may be steam. The steam may preferably be caused to flow in an annular flow path in surrounding relationship to an outer wall of the chamber with the injecting being accomplished via an opening provided in said wall. The heating is accomplished both by intermixing of steam with fluid fuel in the chamber and by heat transfer through the wall.

In accordance with yet a further preferred aspect of the invention, yet another high efficiency method is provided for atomizing a liquid fuel. In this form of the invention, the method includes providing a liquid fuel and causing the same to flow into and through a pre-heating chamber; heating the liquid fuel in the chamber; delivering heated fuel from the chamber and causing the same to flow into and through a first elongated port in an atomizing tip connected to the chamber; directing a pressurized atomizing fluid into a second elongated port in tip and causing the fluid to flow through the second port; introducing the heated fuel from the first port into the second port and causing the same to become intimately intermixed with the pressurized atomizing fluid so as to atomize the heated fuel and provide an admixture comprising atomized fuel and atomizing fluid; and discharging the admixture from the tip.

Preferably, in accordance with the concepts and principles of the invention, the chamber is elongated and generally tubular in form and the atomizing fluid is steam. The steam may be caused to flow in an annular flow path in surrounding relationship to an outer wall of the chamber and the heating may be accomplished by heat transfer through the wall.

In accordance with the invention, two or more of the aspects of the invention described above may be combined in a single atomizer to achieve optimal operational results.

BRIEF DESCRIPTION OF THE DRAWINGS

FIG. 6 is a cross-sectional view of the delivery tube of FIG. 5 taken essentially along the line 6—6 of FIG. 5;

FIG. 7 is a cross-sectional view of the atomizer taken along the line 7—7 of FIG. 1; and FIG. 8 is a schematic illustration of the action of the fluids passing through the y-shaped port array of the invention.

DETAILED DESCRIPTION OF PREFERRED EMBODIMENTS OF THE INVENTION

Figure 1:
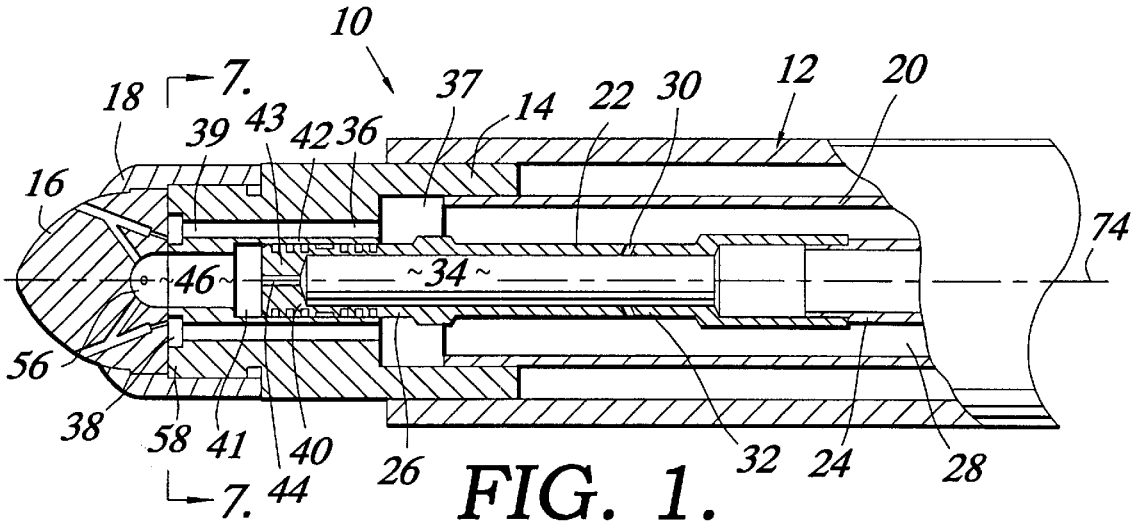
FIG. 1 is a elevational view, partly in cross-section, illustrating an atomizer which embodies the principles and concepts of the invention.

A high efficiency fuel oil atomizer nozzle which embodies the concepts and principles of the invention is illustrated in the drawings where it is broadly identified by the reference numeral 10. As illustrated, the atomizer nozzle 10 is designed to employ a Y-jet atomization principle; however, there are several aspects of the invention which do not necessarily require the use of the Y-jet nozzle tip. With reference to FIG. 1, atomizer nozzle 10 includes a main body portion 12, an intermediate structure portion 14, an atomization tip 16, and a tip shroud portion 18.

The main body portion 12 of the nozzle 10, as shown, includes concentric tubes 20 and 22. Internal tube 22 is in the form of an elongated generally tubular member which may preferably have an upstream segment 24 having an upstream end that is adapted in a conventional manner for connection to a source of liquid fuel and a downstream segment 26. Fuel oil is delivered through tube 22 while steam or some other atomizing fluid, such as, for example, pressurized air, is delivered through the external tube 20 which presents an elongated, generally annular pressurized atomizing fluid supply conduit 28 that surrounds tube 22. The upstream end of conduit 28 is also adapted in a conventional manner for connection to a source of pressurized atomizing fluid. In connection with the foregoing, it will be appreciated by the routineers in the fuel nozzle art that steam may be the preferred atomizing fluid whenever the fuel is a heavy fuel oil. On the other hand, when the fuel of choice is a lighter, more volatile oil, pressurized air may be the preferred atomizing fluid.

As is well known to those of ordinary skill in the art field which is applicable to the invention, the fuel oil may pass through a small orifice (not shown) before it is introduced into the downstream segment 26. Such a small orifice is used to control the flow of the fuel oil. In addition, the fuel oil may be partially atomized as a result of having passed through such an orifice.

One or more orifices 30 may be provided in a wall 32 of the downstream segment 26 of tube 22. These orifices 30 intercommunicate conduit 28 and a chamber 34 provided inside of segment 26 and thereby allow a portion of the steam or other atomizing fluid flowing in conduit 28 to be diverted into a chamber 34 where it is admixed with and acts to atomize fuel oil. To facilitate such flow, the atomizing fluid should desirably have a pressure which is greater, preferably 10 to 20 psi greater, than the pressure of the oil in segment 26. The steam or other atomizing fluid flowing through the orifices 30 is intermixed with the fuel oil in chamber 34 and atomizes or further atomizes the fuel oil. Thus, the chamber 34 may be referred to as a pre-atomizer chamber. The function of the pre-atomizer chamber 34 is thus to facilitate the pre-atomization of the fuel oil and the pre-mixing of the oil and the atomizer fluid.

The intermediate portion 14 of the atomizer 10 may include a plurality of bores or tubes 36 which are in fluid communication with conduit 28 via an annular chamber 37 as shown. Although the atomizer of the invention is illustrated as having four holes (See FIG. 7), it will be recognized by those skilled in the art that the actual number of bores 36 may vary depending upon the amount of steam which is desired for atomizing fuel in atomization tip 16. In some case, in accordance with the concepts and principles of the invention, the atomizer 10 may have as many as ten or more bores 36 in portion 14. Generally speaking, the bores 36 may preferably be spaced evenly around the longitudinal axis 74 of atomizer 10. Whatever the number thereof, the downstream ends 39 of bores 36 are arranged to open into an annular groove 38 provided in portion 14.

The downstream end 40 of segment 26 is received in an opening 41 in portion 14 and the joint between end 40 and opening 41 may preferably be sealed by a series of labyrinth grooves 42 as shown. In this regard it is to be noted also that chamber 34 in segment 26 is closed off at end 40 by an annular portion 43 presenting a hole 44 of reduced diameter. Hole 44 intercommunicates chamber 34 in segment 26 and a chamber 46 in portion 14 via the portion of opening 41 which is not filled by end 40.

Figure 2:
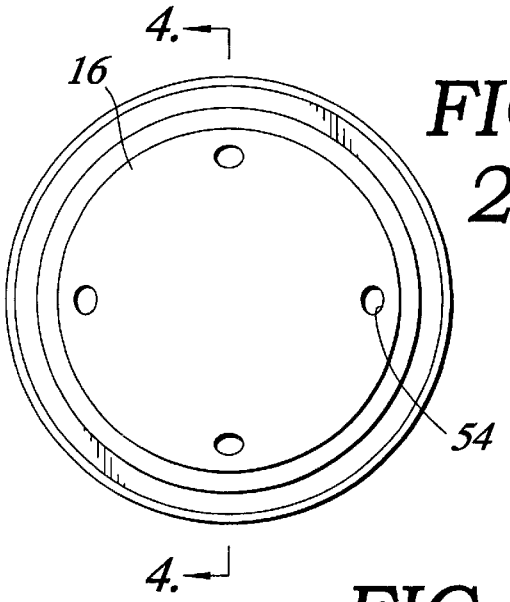
FIG. 2 is an enlarged plan view of the atomizer nozzle tip which is a part of the atomizer of FIG. 1.
Figure 4:
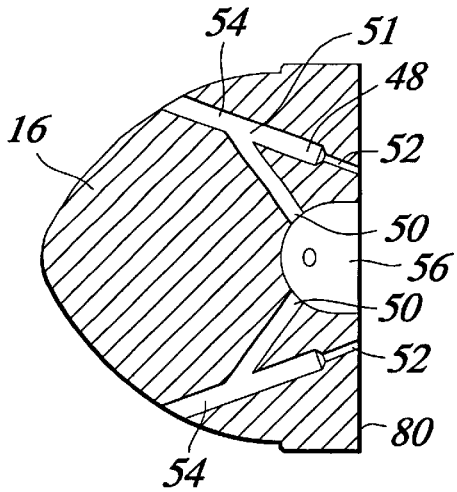
FIG. 4 is an enlarged cross sectional view of the atomizer nozzle tip taken along line 4—4 of FIG. 2.
Figure 3:
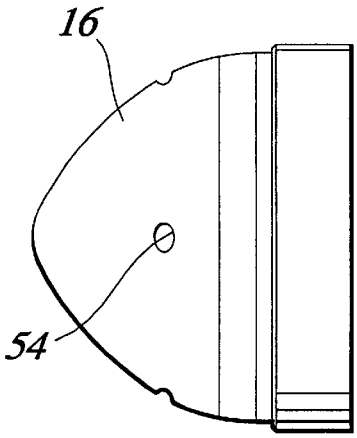
FIG. 3 is an enlarged elevational view of the atomizer nozzle tip.
Figure 5:
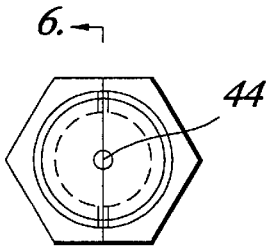
FIG. 5 is an enlarged end view of the central oil delivery tube which is a part of the atomizer of FIG. 1.

Atomization tip 16 of the atomizer nozzle 10 is best shown in FIGS. 2, 3 and 4 of the drawings. Tip 16 preferably includes an internal chamber 56 and a mixing port arrangement which preferably is in the form of a plurality of generally y-shaped port arrays 48 which extend through tip 16. As shown, tip 16 has four of these y-shaped port arrays 48, however, the actual number may vary depending upon the desired operational characteristics of the burner in which the atomizer nozzle 10 is used. It is to be noted in regard to the tip that in accordance with the broadest aspects of the invention, the exact configuration of the mixing ports is not critical so long as the tip operates to bring the atomizing fluid into intimate contact with the liquid fuel in a manner such that the liquid fuel is atomized.

Even though the tip 16 may include a plurality of y-shaped port arrays 48, these port arrays are of essentially the same configuration. Accordingly, for purposes of the present description only one port array 48 will be described with reference to FIGS. 2, 3 and 4. Each port array 48 preferably may include a fuel oil port 50 that is arranged in fluid communication with the chamber 34 via hole 44, chamber 46 and chamber 56, and an atomizing fluid port 51 which includes an entrance portion 52 that is arranged in fluid communication with the conduit 28 via groove 38, tubes 36, and chamber 37, and an outlet port portion 54 that is in fluid communication with both the port 50 and the entrance portion 52. As can be seen viewing FIG. 4, the outlet port portion 54 and the atomizing fluid entrance port portion 52 are in substantial alignment. As can also be seen viewing FIG. 1, internal chamber 56 is aligned with and is arranged in fluid communication with chamber 46 in intermediate portion 14. Fuel oil port 50 opens into and is in fluid communication with chamber 56 as shown. Entrance portion 52 is of a reduced diameter relative to portion 54 and opens into and is in fluid communication with annular groove 38.

Tip 16 preferably has a flat surface 80 which sealingly engages a pair of flat annular surfaces 82 and 84 (see FIG. 7) of segment 58 of portion 14 as shown. The tip shroud 18, which may be attached to a reduced diameter segment 58 of intermediate portion 14 by threads or welding or the like, simply holds the tip 16 and the intermediate portion 14 together as shown in FIG. 1, with surface 80 in sealing contact with surfaces 82 and 84.

In operation, using superheated steam as an atomization fluid, and with reference to the embodiment illustrated in the drawings, steam is injected into chamber 34 via apertures 30 and mixes with and at least partially atomizes oil in chamber 34. A mixture of fuel oil and steam then flows out of pre-atomizer chamber 34, through hole 44, through chambers 46 and 56, and into the ports 50. This pre-atomized mixture of fuel oil and steam is thus divided into as many streams as there are port arrays 48 in the atomizer tip 16.

The stream passing through each port 50 shoots into the corresponding outlet port portion 54 at an angle, as is best shown in FIGS. 4 and 8. It has been determined that the stream passing through port 50, which comprises a pre-atomized mixture of fuel oil and steam, and which shoots into outlet port portion 54 at an angle, thereby forms an annular conical sheet of the fuel oil/steam mixture along the internal wall of outlet port portion 54. This conical sheet is shown schematically in FIG. 8, where it is identified by the reference numeral 70.

Steam from conduit 28 passes through bores 36 and collects in annular groove 38. Since entrance portions 52 of ports 51 are in fluid communication with groove 38, steam is also divided into as many streams as there are port arrays 48 in the atomizer tip 16. The steam from groove 38 travels through portion 52 and joins the fuel-steam mixture shooting into port portion 54 from the port 50. The steam from port portion 52, which preferably is traveling at sonic velocity, pierces the conical sheet as shown schematically by the arrows 72 in FIG. 8 and becomes intimately intermixed with the steam-fuel oil mixture from port 50, whereby further atomization occurs in outlet portion 54. Thus, outlet portion 54 serves as a final mixing chamber for the final oil-steam mixture. In this latter regard, it is to noted that in the portion 54, the fuel is pushed out against the inner wall of the portion 54 where it is in the form of a hollow annular flow. The atomizing fluid is in the hollow center whereby the contact area between the atomizing fluid and the fuel is maximized.

In accordance with the preferred aspects of the invention, the amount of the atomizing fluid which is injected into the chamber 34 through apertures 30 way vary from about 15% to about 75% of the total flow of the atomizing fluid. The remainder, of course will be injected into port 51 through port portion 52. It is also to be recognized in this regard, however, that if the atomizing fluid is heated, such as it would be if it were steam, a certain improvement in efficiency will be obtained even if no apertures are provided and 100% of the atomizing fluid is channeled through port 51. In such a case, the tubes 20, 22 act as a heat exchanger to cause the fuel in tube 22 to become heated. The result is that the viscosity of the fuel is decreased and the atomizing thereof which takes place in the nozzle tip 16 is thus facilitated.

It is to be particularly noted, that in accordance with the invention, the steam travels in a straight line after it enters portion 52, whereby high steam velocity (preferably sonic) is facilitated until such time as the steam encounters the annular conical sheet 70 of fuel oil mixed with steam exiting from port 50. Such high velocity steam exerts a very high shear force against the annular conical sheet 70 formed by the steam-fuel oil mixture exiting from port 50 and shooting into portion 54 at an angle. This interaction facilitates the atomization of the fuel oil into a fine mist.

When the fuel oil is pre-mixed with a portion of the atomizing fluid in chamber 34, as described above, the oil port 50 of the y-shaped port array 48 is preferably enlarged so as to carry the greater volume of fluid, whereby clogging is reduced and minimized. Moreover, and particularly when the atomizing fluid is heated, such as would be the case when steam is used as the atomizing fluid, the viscosity of the fuel oil is reduced so as to increase the overall efficiency of the atomization process. In accordance with the preferred aspects of the invention, the ratio of the cross-sectional flow area of each port 50 to the cross-sectional flow area of each corresponding port portion 52 may preferably be within the range of from about 1.2 to about 3, depending upon the split of the atomizing medium between premixing and atomizing. It is to be noted also that Port 54 is necessarily larger in cross-sectional flow area then either port 50 or 52 because it must be large enough to carry the both the fuel and the total amount of the atomizing fluid. Preferably, the flow area of each port 54 may range from about 1 to about 1.7 times the total of the flow areas of the corresponding port 50 and port portion 52. But it is to be noted that the port sizes may vary depending upon desired results and upon the ratio of total atomizing fluid to fuel and the relative amount of atomizing fluid that is injected into chamber 34 via apertures 30. As is well known to the routineers in the burner art, the main design parameters are flame length and $NO_x$ emissions. A long flame will reduce the $NO_x$ emissions while a short flame does the opposite. Accordingly, the designer is called upon to decide what trade-offs are desirable for any given application.

Port 51 is preferably positioned at an angle relative to a longitudinal axis 74 of the fuel oil atomizer 10. This angle may preferably range from about 2° to about 30°, depending on what is needed for optimizing the overall application. As will be appreciated by those skilled in the burner art, the desirable spray angle may change from application to application. The angle of port 50 relative to port 51 may also vary, depending upon the angle of port 51 relative to longitudinal axis 74 and the relative size of the nozzle tip 16. Preferably this angle between ports 50 and 51 may range from about 15° to about 70°.

The fuel oil atomizer nozzle 10 of the present invention provides a number of benefits which were not previously known in the prior art. These benefits include, but are not necessarily limited to, (1) the concentric tubes 20, 22 for oil and atomizing fluid facilitate the injection of atomizing fluid into the fuel via apertures such as the apertures 30 as well as the heating of the fuel, (2) the configuration of the y-shaped port arrays 48 in the nozzle tip 16 provides for the straight line travel of the steam and the angled entrance of the fuel oil into the final mixing chamber, (3) the monolithic design of the nozzle tip 16 provides improved efficiency and economics, (4) atomization of the fuel prior to discharge of the same into the burner is improved as a result of the double atomization provided first in the pre-atomizer and secondly in the y-shaped port array, (5) the mixing of oil with steam in the pre-atomizer facilitates the use of larger oil ports in the y-shaped port array whereby clogging is minimized, and since clogging is often encountered in low oil flow rate nozzles, the invention therefore covers a wider range of boiler capacities, (6) combustion turndown ratios of oil sprays are improved for the same reasons discussed above, (7) the steam surrounding the oil passageway in the concentric tubes helps to maintain a reduced viscosity in the oil whereby energy is saved, (8) mixing oil with steam in the pre-atomizer results in reduced oil viscosity and enhances atomization efficiency and effect, and (9) the straight line steam passage and the overall configuration provided in the y-shaped port array preserve steam momentum and shape the oil so that higher shearing forces and larger shearing contact surfaces are experienced when the steam and the fuiel oil collide in the final mixing chamber 54, whereby atomization is optimized and steam consumption is reduced.

Through the use of the concentric tubes 20, 22, heat is readily transferred from the steam in the outer tube 22 to the fuel oil in the center tube 20, to thereby heat up the fuel oil and decrease its viscosity. Atomization is facilitated when the viscosity of the oil is lower. In addition, with the concentric tubes 20, 22, it is a simple matter to provide one or more passageways 30 for introduction of steam into the fuel oil in chamber 34 for pre-atomization purposes.

The configuration of the y-shaped port arrays 48 provides for straight line travel of the steam and angular travel of the fuel oil and insures the maximization of the shear forces when the steam encounters the conical sheet 70 of oil shooting into the mixing chamber provided in port portion 54. The straight atomizing fluidjets 72 contain higher momentum than a jet of atomizing fluid that is forced to turn. On the other hand, the angular injection of the fuel oil-steam mixture from port 50 creates a conical sheet 70. The conical sheet 70 not only reduces the characteristic thickness of the bulk liquid, but also increases the contact surface which is encountered by the high momentum atomizing fluid. Both aspects, i.e., straight line atomizing fluid flow and conical mixture sheet, greatly enhance the atomization process. Thus, atomizing fluid energy is conserved thereby increasing the efficiency of the atomization process.

We claim:

1. A high efficiency liquid fuel atomizer comprising:

an elongated generally tubular member defining a liquid fuel pre-atomization chamber, said member having an outer wall that extends at least partially around said chamber, an upstream end adapted for connection to a source of liquid fuel and a downstream fuel delivery outlet;

structure defining a generally annular pressurized atomizing fluid supply conduit disposed in surrounding relationship relative to said chamber, said structure including a conduit inlet adapted for connection to a source of pressurized atomizing fluid and a downstream pressurized atomizing fluid delivery outlet, said outer wall having at least one orifice therethrough intercommunicating said chamber and said conduit to permit pressurized atomizing fluid to enter said chamber and at least partially atomize said fluid fuel therein; and an atomizing tip including at least one mixing port arrangement that is in fluid communication with said outlets for receiving and intermixing at least partially atomized liquid fuel from said chamber and pressurized atomizing fluid from said conduit whereby to further atomize said liquid fuel.

2. A high efficiency fuel oil atomizer as set forth in claim 1, wherein said port arrangement comprises a y-shaped array which includes a first elongated port having an upstream end in fluid communication with said fuel delivery outlet and a downstream end and a second elongated port having an upstream end in fluid communication with said fluid delivery outlet and a downstream end, said ports being arranged at an angle, said first port being positioned such that the downstream end thereof intersects with said second port at a location between the ends of the latter, whereby at least partially atomized fuel passing through said first port is intermixed in said second port with atomizing fluid passing through said second port and atomized further thereby and an admixture of atomized fuel and atomizing fluid is discharged through the downstream end of the second port.

3. A high efficiency fuel oil atomizer as set forth in claim 2, wherein said at least partially atomized fluid fuel from said first port is introduced into said second port as a cone shaped sheet that is pierced by the atomizing fluid flowing through the second port.

4. A high efficiency fuel oil atomizer as set forth in claim 2, wherein a first portion of the second port adjacent said upstream end thereof has a smaller diameter than a second portion of the second port which extends from said location to said downstream end of the second port.

5. A high efficiency fuel oil atomizer as set forth in claim 4, wherein the ratio of the cross-sectional flow area of the first port to the cross-sectional flow area of the first portion of the second port ranges from about 1.2 to about 3.

6. A high efficiency fuel oil atomizer as set forth in claim 5, wherein the ratio of the cross-sectional flow area of the second portion of the second port to the total of the cross-sectional flow areas of the first port and the first portion of the second port ranges from about 1 to about 1.7.

7. A high efficiency fuel oil atomizer as set forth in claim 4, wherein the ratio of the cross-sectional flow area of the second portion of the second port to the total of the cross-sectional flow areas of the first port and the first portion of the second port ranges from about 1 to about 1.7.

8. A high efficiency fuel oil atomizer as set forth in claim 2, wherein the angle between a longitudinal axis of the first port and a longitudinal axis of the second port ranges from about 15° to about 70°.

9. A high efficiency fuel oil atomizer as set forth in claim 2, wherein the angle between a longitudinal axis of the second port and a longitudinal axis of atomizer ranges from about 2° to about 30°.

10. A high efficiency liquid fuel atomizer comprising:

an elongated generally tubular member defining a liquid fuel pre-heating chamber, said member having an outer wall that extends at least partially around said chamber, an upstream end adapted for connection to a source of liquid fuel and a downstream fuel delivery outlet;

structure defining a generally annular pressurized atomizing fluid supply conduit disposed in surrounding relationship relative to said chamber, said structure including a conduit inlet adapted for connection to a source of heated pressurized atomizing fluid and a downstream pressurized atomizing fluid delivery outlet, at least a portion of said outer wall being formed of a heat conductive material, said portion having an inner surface positioned for being contacted by liquid fuel in said chamber and an outer surface positioned for being contacted by heated pressurized atomizing fluid in said conduit whereby to heat said fuel by transfer of heat from said heated fluid to said fuel; and an atomizing tip including at least one mixing port arrangement that is in fluid communication with said outlets for receiving and intermixing heated liquid fuel from said chamber and atomizing fluid from said conduit whereby to atomize said heated liquid fuel.

11. A high efficiency fuel oil atomizer as set forth in claim 10, wherein said outer wall has at least one orifice therethrough intercommunicating said chamber and said conduit to permit said heated and pressurized atomizing fluid to enter said chamber and at least partially atomize said fluid fuel therein.

12. A high efficiency fuel oil atomizer as set forth in claim 11, wherein said port arrangement comprises a y-shaped array which includes a first elongated port having an upstream end in fluid communication with said fuel delivery outlet and a downstream end and a second elongated port having an upstream end in fluid communication with said fluid delivery outlet and a downstream end, said ports being arranged at an angle, said first port being positioned such that the downstream end thereof intersects with said second port at a location between the ends of the latter, whereby the heated and at least partially atomized fuel passing through said first port is intermixed in said second port with atomizing fluid passing through said second port and atomized further thereby and an admixture of atomized fuel and heated atomizing fluid is discharged through the downstream end of the second port.

13. A high efficiency fuel oil atomizer as set forth in claim 12, wherein said at least partially atomized fluid fuel from said first port is introduced into said second port as a cone shaped sheet that is pierced by the atomizing fluid flowing through the second port.

14. A high efficiency fuel oil atomizer as set forth in claim 12, wherein a first portion of the second port adjacent said upstream end thereof has a smaller diameter than a second portion of the second port which extends from said location to said downstream end of the second port.

15. A high efficiency fuel oil atomizer as set forth in claim 14, wherein the ratio of the cross-sectional flow area of the first port to the cross-sectional flow area of the first portion of the second port ranges from about 1.2 to about 3.

16. A high efficiency fuel oil atomizer as set forth in claim 15, wherein the ratio of the cross-sectional flow area of the second portion of the second port to the total of the cross-sectional flow areas of the first port and the first portion of the second port ranges from about 1 to about 1.7.

17. A high efficiency fuel oil atomizer as set forth in claim 14, wherein the ratio of the cross-sectional flow area of the second portion of the second port to the total of the cross-sectional flow areas of the first port and the first portion of the second port ranges from about 1 to about 1.7.

18. A high efficiency fuel oil atomizer as set forth in claim 12, wherein the angle between a longitudinal axis of the first port and a longitudinal axis of the second port ranges from about 15° to about 70°.

19. A high efficiency fuel oil atomizer as set forth in claim 12, wherein the angle between a longitudinal axis of the second port and a longitudinal axis of atomizer ranges from about 2° to about 30°.

20. A high efficiency fuel oil atomizer as set forth in claim 10, wherein said port arrangement comprises a y-shaped array which includes a first elongated port having an upstream end in fluid communication with said fuel delivery outlet and a downstream end and a second elongated port having an upstream end in fluid communication with said fluid delivery outlet and a downstream end, said ports being arranged at an angle, said first port being positioned such that the downstream end thereof intersects with said second port at a location between the ends of the latter, whereby heated fuel passing through said first port is intermixed in said second port with atomizing fluid passing through said second port and atomized thereby and an admixture of atomized fuel and heated atomizing fluid is discharged through the downstream end of the second port.

21. A high efficiency fuel oil atomizer as set forth in claim 20, wherein said at least partially atomized fluid fuel from said first port is introduced into said second port as a cone shaped sheet that is pierced by the atomizing fluid flowing through the second port.

22. A high efficiency fuel oil atomizer as set forth in claim 20, wherein a first portion of the second port adjacent said upstream end thereof has a smaller diameter than a second portion of the second port which extends from said location to said downstream end of the second port.

23. A high efficiency fuel oil atomizer as set forth in claim 22, wherein the ratio of the cross-sectional flow area of the first port to the cross-sectional flow area of the first portion of the second port ranges from about 1.2 to about 3.

24. A high efficiency fuel oil atomizer as set forth in claim 23, wherein the ratio of the cross-sectional flow area of the second portion of the second port to the total of the cross-sectional flow areas of the first port and the first portion of the second port ranges from about 1 to about 1.7.

25. A high efficiency fuel oil atomizer as set forth in claim 22, wherein the ratio of the cross-sectional flow area of the second portion of the second port to the total of the cross-sectional flow areas of the first port and the first portion of the second port ranges from about 1 to about 1.7.

26. A high efficiency fuel oil atomizer as set forth in claim 20, wherein the angle between a longitudinal axis of the first port and a longitudinal axis of the second port ranges from about 15° to about 70°.

27. A high efficiency fuel oil atomizer as set forth in claim in the angle between a longitudinal axis of the second port and a longitudinal axis of atomizer ranges from about 2° to about 30°.

28. A high efficiency, one piece atomizing nozzle tip for admixing a liquid fuel with a pressurized atomizing fluid so as to atomize the liquid fuel, said nozzle tip comprising:

a monolithic metallic main nozzle tip body;

a y-shaped port arrangement in said body, said arrangement including a first elongated essentially straight fuel port having an upstream end and a downstream end and a second elongated essentially straight atomizing fluid port having an upstream end and a downstream end, said ports having essentially circular cross-sectional flow areas and being arranged at an angle relative to one another, said first port being positioned such that the downstream end thereof intersects with said second port at a location between said ends of the latter, whereby fuel passing through said first port is intermixed in said second port with atomizing fluid passing through said second port and an admixture of atomized fuel and atomizing fluid is discharged through the downstream end of the second port.

29. A high efficiency, one piece atomizing nozzle tip as set forth in claim 28, wherein a first portion of the second port adjacent said upstream end thereof has a smaller diameter than a second portion of the second port which extends from said location to said downstream end of the second port.

30. A high efficiency, one piece atomizing nozzle tip as set forth in claim 29, wherein the ratio of the cross-sectional flow area of the first port to the cross-sectional flow area of the first portion of the second port ranges from about 1.2 to about 3.

31. A high efficiency, one piece atomizing nozzle tip as set forth in claim 30, wherein the ratio of the cross-sectional flow area of the second portion of the second port to the total of the cross-sectional flow areas of the first port and the first portion of the second port ranges from about 1 to about 1.7.

32. A high efficiency, one piece atomizing nozzle tip as set forth in claim 29, wherein the ratio of the cross-sectional flow area of the second portion of the second port to the total of the cross-sectional flow areas of the first port and the first portion of the second port ranges from about 1 to about 1.7.

33. A high efficiency, one piece atomizing nozzle tip as set forth in claim 28, wherein the angle between a longitudinal axis of the first port and a longitudinal axis of the second port ranges from about 15° to about 70°.

34. A high efficiency liquid fuel atomizer comprising:

an elongated generally tubular member defining a liquid fuel pre-atomization chamber, said member having an outer wall that extends at least partially around said chamber, an upstream end adapted for connection to a source of liquid fuel and a downstream fuel delivery outlet;

structure defining a generally annular pressurized atomizing fluid supply conduit disposed in surrounding relationship relative to said chamber, said structure including a conduit inlet adapted for connection to a source of pressurized atomizing fluid and a downstream pressurized atomizing fluid delivery outlet, said outer wall having at least one orifice therethrough intercommunicating said chamber and said conduit to permit pressurized atomizing fluid to enter said chamber and at least partially atomize said fluid fuel therein; and a high efficiency, one piece atomizing nozzle tip for receiving partially atomized fuel from said fuel delivery outlet liquid fuel and pressurized atomizing fluid from said atomizing fluid delivery outlet, said atomizing nozzle tip including at least one mixing port arrangement that is in fluid communication with said outlets for receiving and admixing at least partially atomized liquid fuel from said chamber and pressurized atomizing fluid from said conduit whereby to further atomize said liquid fuel, said nozzle tip comprising a monolithic metallic main nozzle tip body, said port arrangement being y-shaped and including (1) a first elongated essentially straight fuel port having an upstream end in fluid communication with said fuel delivery outlet and a downstream end, and (2) a second elongated essentially straight atomizing fluid port having an upstream end in fluid communication with said fluid delivery outlet and a downstream end, said ports having essentially circular cross-sectional flow areas and being arranged at an angle relative to one another, said first port being positioned such that the downstream end thereof intersects with said second port at a location between said ends of the latter, whereby fuel passing through said first port is intermixed in said second port with atomizing fluid passing through said second port and an admixture of atomized fuel and atomizing fluid is discharged through the downstream end of the second port.

35. A high efficiency liquid fuel atomizer comprising:

an elongated generally tubular member defining a liquid fuel pre-heating chamber, said member having an outer wall that extends at least partially around said chamber, an upstream end adapted for connection to a source of liquid fuel and a downstream fuel delivery outlet;

structure defining a generally annular pressurized atomizing fluid supply conduit disposed in surrounding relationship relative to said chamber, said structure including a conduit inlet adapted for connection to a source of heated pressurized atomizing fluid and a downstream pressurized atomizing fluid delivery outlet, at least a portion of said outer wall being formed of a heat conductive material, said portion having an inner surface positioned for being contacted by liquid fuel in said chamber and an outer surface positioned for being contacted by heated pressurized atomizing fluid in said conduit whereby to heat said fuel by transfer of heat from said heated fluid to said fuel; and a high efficiency, one piece atomizing nozzle tip for receiving heated fuel from said fuel delivery outlet and pressurized atomizing fluid from said atomizing fluid delivery outlet, said atomizing nozzle tip including at least one mixing port arrangement that is in fluid communication with said outlets for receiving and admixing heated fuel from said chamber and pressurized atomizing fluid from said conduit whereby to further atomize said liquid fuel, said nozzle tip comprising a monolithic metallic main nozzle tip body, said port arrangement being y-shaped and including (1) a first elongated essentially straight fuel port having an upstream end in fluid communication with said fuel delivery outlet and a downstream end, and (2) a second elongated essentially straight atomizing fluid port having an upstream end in fluid communication with said fluid delivery outlet and a downstream end, said ports having essentially circular cross-sectional flow areas and being arranged at an angle relative to one another, said first port being positioned such that the downstream end thereof intersects with said second port at a location between said ends of the latter, whereby fuel passing through said first port is intermixed in said second port with atomizing fluid passing through said second port and an admixture of atomized fuel and atomizing fluid is discharged through the downstream end of the second port.

* * * * *

UNITED STATES PATENT AND TRADEMARK OFFICE

CERTIFICATE OF CORRECTION

PATENT NO. : 6,478,239 B2
DATED : November 12, 2002
INVENTOR(S) : I-Ping Chung and Christoph Strupp It is certified that error appears in the above-identified patent and that said Letters Patent is hereby corrected as shown below:

Title page,
Item [56], References Cited, OTHER PUBLICATIONS, delete "(abstract." and replace with -- abstract --.

Column 8,
Line 13, delete "fuiel" and replace with -- fuel --.
Line 28, delete "fluidjets" and replace with -- fluid jets --.

Column 11,
Line 34, delete "in" and replace with -- 20, wherein --.

Signed and Sealed this

Thirtieth Day of September, 2003

JAMES E. ROGAN
*Director of the United States Patent and Trademark Office*